United States Patent [19]

Essebaggers

[11] 4,140,176

[45] Feb. 20, 1979

[54] PROTECTIVE TUBES FOR SODIUM HEATED WATER TUBES

[75] Inventor: Jan Essebaggers, 39 Honeyman Dr., Succasunna, N.J. 07876

[73] Assignee: The United States of America as represented by the United States Department of Energy, Washington, D.C.

[21] Appl. No.: 345,043

[22] Filed: Mar. 26, 1973

[51] Int. Cl. ..... F28f 9/22

[52] U.S. Cl. ..... 165/134 R; 122/483; 165/70; 165/142; 165/160

[58] Field of Search ..... 165/142, 160, 134, 70; 122/483

[56] References Cited

U.S. PATENT DOCUMENTS

| | | | |
|---|---|---|---|
| 2,037,316 | 4/1936 | Fenske | 165/142 |
| 2,225,634 | 12/1940 | Houdry | 165/142 X |
| 2,936,159 | 5/1960 | Boni, Jr. | 165/142 |
| 3,085,626 | 4/1963 | Bognar et al. | 165/142 X |
| 3,090,433 | 5/1963 | Amorosi et al. | 165/142 |
| 3,183,167 | 5/1965 | Bradley | 165/142 |
| 3,545,412 | 12/1970 | Kinyon | 122/483 X |
| 3,557,760 | 1/1971 | Romanos et al. | 122/483 X |
| 3,726,339 | 4/1973 | Ash | 165/134 |
| 3,741,164 | 6/1973 | Barratt | 165/142 X |

FOREIGN PATENT DOCUMENTS

| | | | |
|---|---|---|---|
| 25510 of | 1898 | United Kingdom | 165/142 |
| 404946 | 1/1934 | United Kingdom | 165/142 |

*Primary Examiner*—Albert W. Davis, Jr.
*Assistant Examiner*—S. J. Richter
*Attorney, Agent, or Firm*—Dean E. Carlson; Randall G. Erdloy; John E. Wilson

[57] ABSTRACT

A heat exchanger in which water tubes are heated by liquid sodium which minimizes the results of accidental contact between the water and the sodium caused by failure of one or more of the water tubes. A cylindrical protective tube envelopes each water tube and the sodium flows axially in the annular spaces between the protective tubes and the water tubes.

6 Claims, 3 Drawing Figures

PROTECTIVE TUBES FOR SODIUM HEATED WATER TUBES

BACKGROUND OF THE INVENTION

One of the more common features found in nuclear power plant designs is the use of liquid sodium to transfer heat from a reactor and to water for the generation of steam. It can also be used to transfer heat to steam to superheat the steam. In such designs, superheaters and steam generators must be designed to minimize the effects of an accidental explosion resulting from unintended contact between the steam or water and liquid sodium. In any design, a heat transfer surface between the sodium and the water or steam may fail and any contact between the water or steam and sodium can result in a pressure which will cause the failure of adjacent heat transfer surfaces and therefore, further contact between those reactants. In effect, a chain reaction occurs.

In the case of a sodium generator in which water is heated by flowing it through tubes which extend through a stream of flowing liquid sodium, a tube failure will often result in a violent reaction which will rupture adjacent tubes to cause further contact between sodium and water and an even greater pressure build-up.

Another problem which exists in sodium heated steam generators is that considerable time usually elapses before it is possible to detect the presence of the reaction. This means that considerable damage is done before it is possible to discontinue the flows of sodium and water or steam into the steam generator, and consequently, the sodium-water reaction is continuously fed with the reactants.

SUMMARY OF THE INVENTION

It is an object of the present invention to overcome drawbacks found in the prior art such as those discussed above. Accordingly, a sodium heated steam generator or superheater consisting of a number of heated tubes carrying water which is generated into steam or steam which is superheated by liquid sodium flowing over the tubes is provided with a number of protective tubes, each of which envelopes one of said heated tubes so that liquid sodium flows axially of the heated tubes in the annular spaces between the protective tubes and the heated tubes so that each heated tube is protected from the effects of an inadvertent sodium-water reaction at an adjacent heated tube.

DETAILED DESCRIPTION OF THE PREFERRED EMBODIMENT

Figure 3:
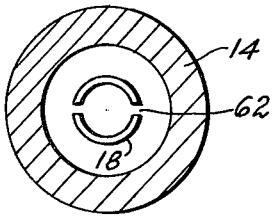
FIG. 3 is a view partly in section taken substantially along the line 3—3 of FIG. 1.
Figure 1:
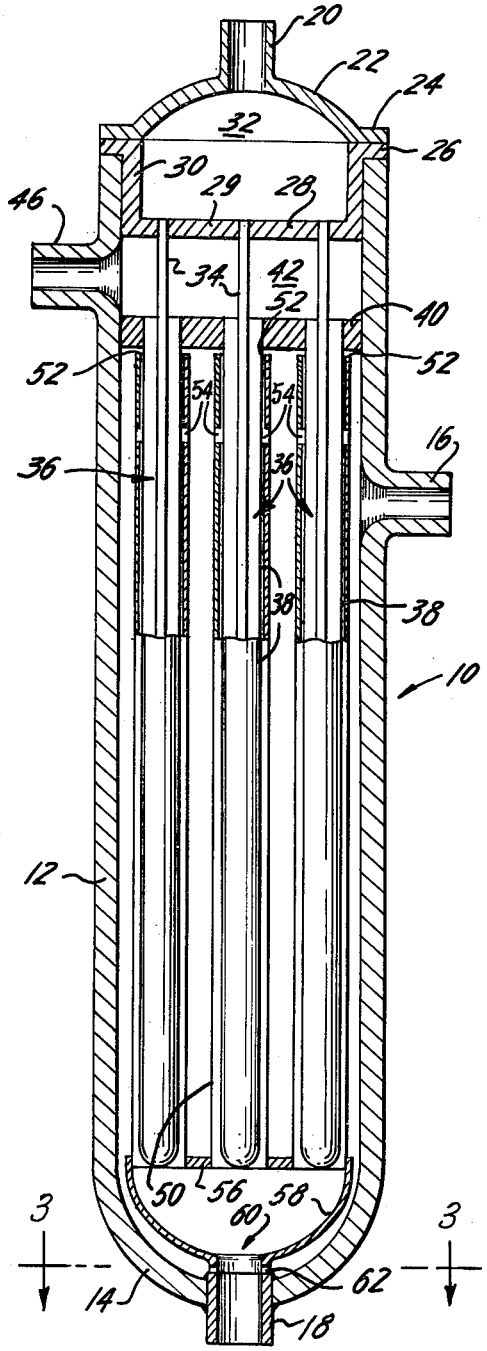
FIG. 1 is an elevational view partly in section of a steam generator made in accordance with the present invention.

FIG. 1 shows a heat exchanger indicated generally as 10, having a generally cylindrical outer shell 12 with a closed lower end 14. The outer shell 12 includes a sodium inlet 16 and a sodium outlet 18, which is positioned centrally in the closed lower end 14 of the outer shell 12. Heat is supplied by hot liquid sodium which enters at the inlet 16 and which flows downwardly to eventually exit at the outlet 18.

Water to be heated to steam or steam to be superheated enters at a water inlet 20 which is located centrally in a dome like upper cover 22 which serves to close the upper end of the cylindrical shell 12. The cover 22 has at its periphery an annular horizontally extending flange 24. The flange 24 and the top of the cylindrical shell 12 clamp between them an annular radially extending lip 26 of an upper tube sheet 28.

The upper tube sheet 28 is generally flat, includes a generally horizontal circular flat portion 29 which is connected to the lip 26 by an annular vertically extending cylindrical sidewall portion 30. The cover 22 and the tube sheet 28 define a chamber 32.

Extending through the upper tube sheet 28 and secured to it are a plurality of inner tubes 34, each of which is a component of one of an equal number of bayonet tube assemblies 36. Each of the bayonet tube assemblies 36 has, in addition to its inner tube 34, an outer tube 38 each of which extends down from a main tube sheet 40.

The main tube sheet 40 is below the upper tube sheet 28 and defines with the upper tube sheet 28 and cylindrical shell 12, a chamber 42.

Each of the outer tubes 38 is closed at its lower end 44 but the inner tubes 34 are open at both ends. Each inner tube's bottom is a little higher than the corresponding closed end 44 of its associated outer tube so that water either in its liquid phase or its gaseous phase (steam) coming in the inlet 20 and filling the chamber 32 will flow downwardly through the inner tubes 34 to impinge against the closed lower ends of the outer tubes 38 to reverse direction and flow upwardly in the annular spaces between the inner tubes 34 and the outer tubes 38. It is during this upward travel that the water is heated. Thus, the outer tubes 38 are the heated tubes. In a steam generator, liquid water is heated and converted to steam. In a superheater, gaseous water (steam) is heated further. In either case, steam will collect in the chamber 42 and leave the heat exchanger 10 through a steam outlet 46 in the side of the heat exchanger 10 between the upper tube sheet 28 and the lower tube sheet 40.

Figure 2:
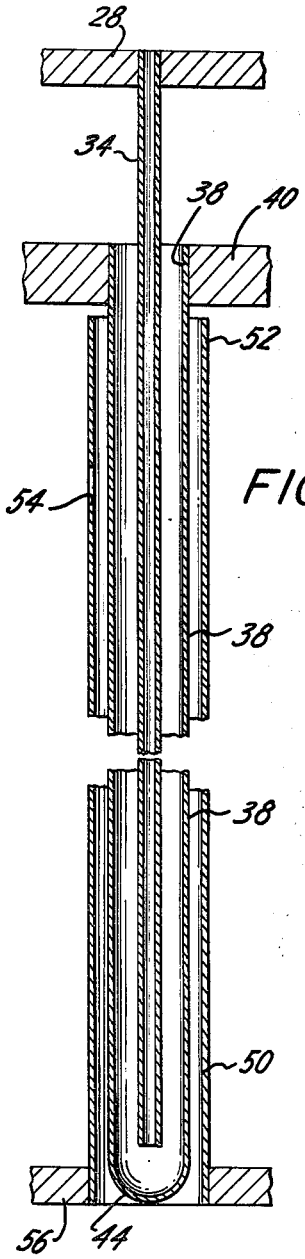
FIG. 2 is a view partly in section of one of the protective tubes shown in FIG. 1 with the water tube within it and the associated tube sheets.

It has already been explained how a failure of a heat exchange surface can result in a sodium-water reaction which can cause considerable damage. In order to minimize this damage, each of the bayonet tube assemblies 36 is provided with a protective tube 50. Each protective tube 50 is cylindrical in configuration and is larger in diameter and coaxial with one of the heated outer tubes 38. Each protective tube 50 extends upwardly to its upper end 52 which is slightly below the main tube sheet 40. Each protective tube 50 has an orifice 54 in its sidewall below the tube sheet 40. Liquid sodium entering the orifices 54 will flow in the annular spaces between the protective tubes 50 and the outer tubes 38. Some of the sodium will flow upward through these spaces and over the tops 52 of the protective tubes but most of it will flow downward to leave the protective tubes at their bottoms. As shown best in FIG. 2, each of the protective tubes has an open bottom 56. The sodium flowing through the annular spaces between the protective tubes 50 and the heated outer tubes 38 supplies heat to water flowing (as liquid or gas) in the annular spaces between the inner tubes 34 and the outer tubes 38.

In its flow upward between the orifices 54 and the tops 52 of the protective tubes 50, the sodium is cooled sufficiently that it will not excessively heat the main tube sheet 40. This eliminates the necessity of a cover gas immediately below the tube sheet 40.

The bottoms of each of the protective tubes 50 is secured to a lower tube sheet 56 which at its periphery is sealingly secured to the periphery of a generally bowl shaped inner shell 58 which covers the closed lower end 14 of the cylindrical outer shell 12.

The lower tube sheet 56 does not extend outward to the outer shell 12, and therefore, the inner shell 58 does not contact at its periphery the outer shell 12. The inner shell 58 has at its bottom a centrally located open neck 60 which extends more or less vertically and has a number of small drains 62. With this arrangement, a body of slow moving sodium which flows out of the protective tubes 50 at their tops 52, flows downward between the spaces between the protective tubes 50 and then, at the lower portion of the heat exchanger, outward, because of the lower tube sheet 56, to flow down and inward in the space between the inner shell 58 and closed lower end 14 of the outer shell 12. This sodium then flows through the drains 62 and out of the steam generator 10 through the sodium outlet 18. The drains 62 are of a size and number to assure that this body of sodium will move at a very slow flow rate so that the amount of sodium following this route will be much less than the sodium which flows down through the protective tubes 50. It prevents the creation of a large temperature gradient across the protective tubes 50.

The present arrangement has the advantage of more or less uniform flow of sodium axially along each of the outer tubes 38. This allows for a better prediction of the hydraulic and thermal performance of the present heat exchanger than would otherwise be possible. These parameters are not as easily predicted in exchangers where the liquid sodium flows over baffles placed along the length of the water tubes.

In the event of a failure of one of the outer tubes 38, any sodium-water reaction will be limited because of the inclusion of protective tubes 50. No adjacent bayonet tube assemblies will be damaged. It is contemplated that the protective tubes 50 will have thicker sidewalls than the outer tubes 38. This is so because the protective tubes 50 have as their main function, the ability to stand up under a sodium-water reaction and its concomitant rise in pressure. The outer tubes 38 must be limited in thickness to assure a good heat transfer if the heat exchanger 10 is to operate efficiently.

Another advantage of the present arrangement is that the products of any sodium-water reaction will flow downwardly more quickly than in a heat exchanger utilizing baffles. This means that any detection device downstream of the bayonet tubes will detect the sodium-water reaction more quickly so that remedial action can be taken.

Another advantage of the present arrangement is that it prevents a slow leak in an outer tube 38 from causing erosion of an adjacent tube. Without the protective tubes 50, a small leak in one of the outer tubes 38 would result in a small stream of products of a sodium-water reaction which would be directed outward from the tube to impinge against one or more adjacent tubes to erode them and eventually result in their failure.

In the present heat exchanger 10, any slow leak in any of the outer tubes 38 would result in an impingement against the associated thick-walled protective tube 50. Further, the adjacent outer tubes 38 are protected from erosion by their associated protective tubes 50.

The foregoing describes but one preferred embodiment of the present invention, other embodiments being possible without exceeding its scope as defined in the following claims.

I claim:

1. A heat exchanger wherein water is heated by liquid sodium comprising:

an outer shell;

a main tube sheet disposed within said outer shell;

a plurality of tubes connected with said main tube sheet and extending downwardly therefrom for carrying water;

a liquid sodium inlet below said main tube sheet;

a liquid sodium outlet below said liquid sodium inlet a plurality of protective tubes, each of said protective tubes being of a larger diameter than and coaxial with one of said water tubes over the entire length of said one water tube and having two axially spaced openings below said main tube sheet and above said liquid sodium outlet and means to assure communication of liquid sodium between said liquid sodium inlet and the uppermost one of said two axially spaced openings of each of said protective tubes;

a body of liquid sodium extending downward from said main tube sheet to said liquid sodium outlet;

whereby when liquid sodium flows through said inlet to form said body of liquid sodium between said main tube sheet and said liquid sodium outlet a portion of said body of liquid sodium will flow in streams downward between said water tubes and said protective tubes between said openings and then out of said sodium outlet and whereby failure of one of said water tubes will result in a sodium-water reaction which will be isolated within one of said protective tubes.

2. A heat exchanger wherein water is heated by liquid sodium comprising:

an outer shell;

a main tube sheet disposed within said outer shell;

a liquid sodium inlet in said shell below said main tube sheet;

a liquid sodium outlet in said shell below said liquid sodium inlet;

an auxiliary tube sheet positioned above said main tube sheet;

a plurality of bayonet tube assemblies, each comprising:

an outer tube having a closed lower end and an open-upper end and secured at said open-upper end to said main tube sheet;

an inner tube open at both ends, said inner tube being of a smaller diameter than and coaxial with said outer tube, one end of said inner tube being secured to said auxiliary tube sheet and the opposite end of said inner tube being adjacent to said closed lower end of said outer tube; and a plurality of protective tubes below said main tube sheet, and being of larger diameter than and coaxial with said outer tubes each of said protective tubes being positioned to envelop one of said outer tubes over substantially all of the length of said one outer tube, each of said protective tubes having an upper opening adjacent to and below said main tube sheet and a lower opening adjacent to said closed lower end of said outer tube;

a body of sodium extending downward from said upper tube sheet to said liquid sodium outlet and means to assure communication of liquid sodium between said liquid sodium inlet and said upper openings;

whereby when water enters said heat exchanger between said auxiliary tube sheet and said main tube sheet it will flow down said inner tubes and then upwardly between said inner tubes and said outer tubes and then out of said heat exchanger, and whereby when sodium is flowed through said sodium inlet to form said body of sodium so that a portion of said liquid sodium body will flow downwardly in streams between said upper openings and said lower openings between said protective tubes and said outer tubes to heat the water flowing up between said outer tubes and said inner tubes and then flow out of said heat exchanger through said sodium outlet, failure of any of said outer tubes will result in a sodium-water reaction which is isolated by one of said protective tubes.

3. The heat exchanger defined in claim 2 wherein said protective tube has an orifice at the upper portion thereof and an open lower end.

4. The heat exchanger defined in claim 3 wherein said protective tube is spaced at its top from said main tube sheet.

5. The heat exchanger defined in claim 4 further comprising a lower tube sheet, said lower tube sheet being secured to said protective tubes adjacent to the bottoms of said protective tubes and serving to support said protective tubes.

6. The heat exchanger defined in claim 5 further comprising an inner shell, said inner shell extending downward and inward from the outer periphery of said lower tube sheet to said sodium outlet, drain shells through said inner shell at the lower portion thereof whereby liquid sodium can flow downward between said protective tubes to flow outward and around the outer periphery of said lower tube sheet and then down between said inner shell and said outer shell and through said drains and then out of said sodium outlet.

* * * * *